US006634295B1

(12) United States Patent
Newington et al.

(10) Patent No.: US 6,634,295 B1
(45) Date of Patent: Oct. 21, 2003

(54) LITHOGRAPHIC PRINTING PLATES AND METHOD FOR THEIR PREPARATION

(75) Inventors: Ian M. Newington, Bucks (GB); Mark A. Harris, Rochester, NY (US); Judith L. Fleissig, Rochester, NY (US); Kristine B. Lawrence, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/857,479

(22) PCT Filed: Dec. 14, 1999

(86) PCT No.: PCT/GB99/04253

§ 371 (c)(1),
(2), (4) Date: Jun. 5, 2001

(87) PCT Pub. No.: WO00/37254

PCT Pub. Date: Jun. 29, 2000

(30) Foreign Application Priority Data

Dec. 22, 1998 (GB) ..... 9828153

(51) Int. Cl.[7] ..... B41C 1/10

(52) U.S. Cl. ..... 101/466; 101/457; 101/462; 347/96

(58) Field of Search ..... 101/457, 462, 101/463.1, 465, 466, 467; 347/96, 100, 101, 102, 105

(56) References Cited

U.S. PATENT DOCUMENTS

| | | | | | |
|---|---|---|---|---|---|
| 5,213,041 | A | | 5/1993 | Kanck | 101/467 |
| 5,312,654 | A | * | 5/1994 | Arimatsu et al. | 347/101 |
| 5,491,050 | A | | 2/1996 | Brust et al. | 430/380 |
| 5,695,908 | A | * | 12/1997 | Furukawa | 101/466 |
| 5,738,013 | A | | 4/1998 | Kellett | 101/463.1 |
| 5,820,932 | A | * | 10/1998 | Hallman et al. | 101/463.1 |
| 6,025,022 | A | * | 2/2000 | Matzinger | 101/463.1 |
| 6,328,408 | B1 | * | 12/2001 | Gelbart | 347/101 |
| 6,354,209 | B1 | * | 3/2002 | Van Aert et al. | 101/466 |
| 6,367,383 | B1 | * | 4/2002 | Leenders et al. | 101/465 |

FOREIGN PATENT DOCUMENTS

| | | |
|---|---|---|
| EP | 0 003 789 | 2/1979 |
| EP | 0 963 841 A1 | 12/1999 |
| GB | 2 332 646 | 6/1999 |

OTHER PUBLICATIONS

Research Disclosure No. 289118 "Ink Jet Recording For Use In Making Lithographic Printing Plates", De Brabandere et al., pp. 351=352, May 1988.*
EP 0 003 789—Abstarct.

* cited by examiner

*Primary Examiner*—Stephen R. Funk

(57) ABSTRACT

A method for the preparation of a lithographic printing plate comprises forming an oleophilic image on the surface of a hydrophilic support by depositing, preferably by ink-jetting, the desired image on the surface using an aqueous emulsion of an organic film-forming polymer which has been prepared by emulsion polymerization, whereby the polymer adheres to the surface of the printing plate forming an oleophilic film. The polymer preferably has functional groups such as sulphonate that bind the polymer to the hydrophilic surface. Preferably the polymer has a glass transition temperature of not greater than about 105° C. and where the glass transition temperature is above 50° C. the polymer, after deposition on the plate, is preferably subjected to a heat treatment to assist in film formation.

9 Claims, 1 Drawing Sheet

FIGURE
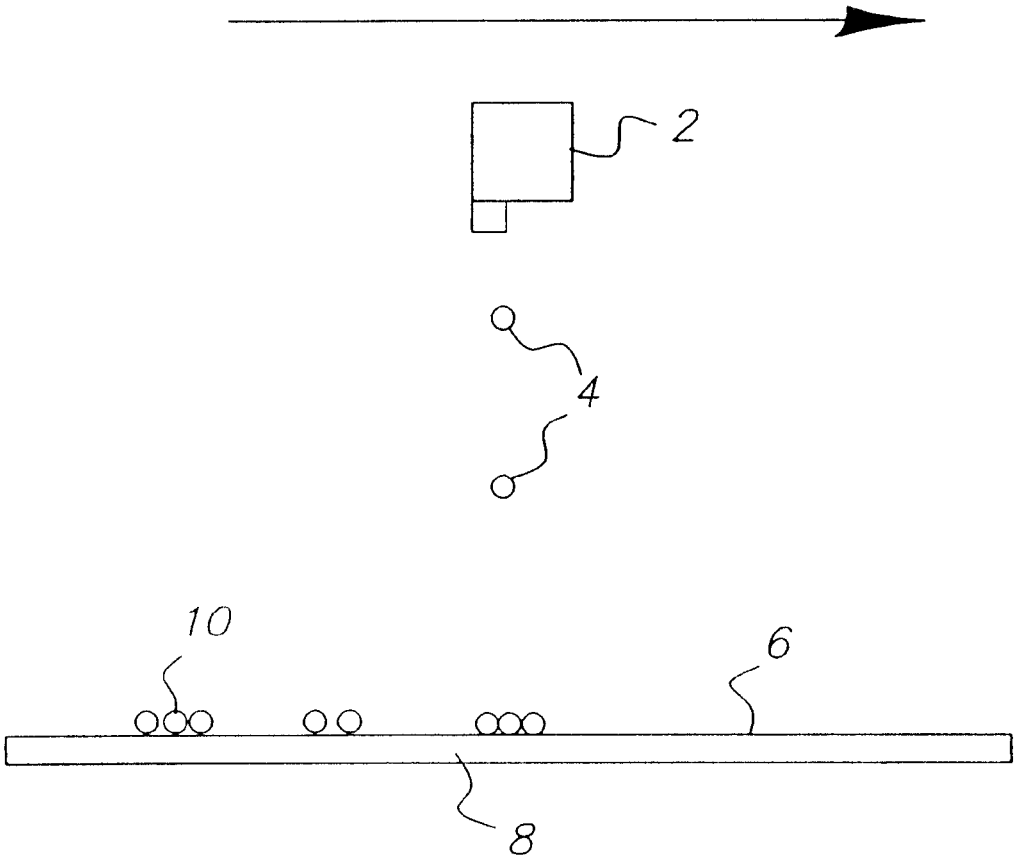

LITHOGRAPHIC PRINTING PLATES AND METHOD FOR THEIR PREPARATION

FIELD OF THE INVENTION

This invention relates to novel printing plates, to a method for their preparation and to a lithographic printing process employing the plates.

BACKGROUND OF THE INVENTION

Printing plates suitable for offset lithographic printing are known which comprise a support having non-image areas which are hydrophilic and image areas which are hydrophobic and ink-receptive.

The art of lithographic printing is based upon the immiscibility of oil and water, wherein the oily material or ink is preferentially retained by the image area and water or fountain solution is preferentially retained by the non-image area. When a suitably prepared surface is moistened with water and an ink is then applied the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket which in turn transfers the ink to the surface of the material upon which the image is to be reproduced.

Ink-jetting is the non-impact method for producing images by the deposition of ink droplets on a substrate in response to digital signals.

JP-A-53015905 describes the preparation of a printing plate by ink-jetting an alcohol-soluble resin in an organic solvent onto an aluminum printing plate.

JP-A-56105960 describes the formation of a printing plate by ink-jetting onto a support e.g. an anodised aluminum plate an ink capable of forming an oleophilic image and containing a hardening substance such as epoxy-soybean oil together with benzoyl peroxide or a photohardening substance such as an unsaturated polyester.

European Patent Application No 0882584 describes a method of preparing a printing plate comprising producing an oleophilic image on the surface of a support by ink-jet printing the image on the surface using an aqueous solution or aqueous colloidal dispersion of a salt of a hydrophobic organic acid e.g. oleic acid.

GB Patent Application No. 2,332,646 describes a method of preparing a printing plate comprising producing an oleophilic image on the surface using an aqueous solution or colloidal dispersion of a polymer bearing water solubilising groups wherein the water-solubilising groups interact with the surface of the support thereby binding the polymer to the support and rendering the polymer insoluble. In the method described the polymer containing water solubilising groups is dispersed in water to form the solution or emulsion.

PROBLEM TO BE SOLVED BY THE INVENTION

Long press runs with plates made by jetting a fluid onto the ink accepting image areas of the plate require that the fluid harden or cross-link into a layer which will not wear off under the conditions of the lithographic A method of preparing printing plates using ink-jetting is required which avoids the use of organic solvents and/or light sensitive materials.

The present invention provides a solution to these problems by a method which employs an aqueous emulsion of an organic polymer prepared by emulsion polymerisation and which is applied to the plate and caused to coalesce.

SUMMARY OF THE INVENTION

According to the present invention there is provided a method for the preparation of a lithographic printing plate which method comprises forming an oleophilic image on the surface of a hydrophilic support by depositing, preferably by ink-jetting, the desired image on the surface using an aqueous emulsion of an organic polymer prepared by emulsion polymerisation wherein the polymer is film-forming and adheres to the surface of the printing plate forming an oleophilic film.

BRIEF DESCRIPTION OF THE DRAWING

The FIGURE shows an ink-jet printer head and droplets of emulsion being jetted onto a hydrophilic surface of a printing plate to produce a hydrophobic image on the support.

ADVANTAGEOUS EFFECT OF THE INVENTION

The method of the invention offers a rapid, simple and direct way to make a printing plate from digital data which avoids the use of organic solvents and/or light sensitive materials.

Compared with the use of a solution of a polymer disclosed in the prior art the use of a polymer emulsion in accordance with present invention can produce an improved quality of image.

DETAILED DESCRIPTION OF THE INVENTION

The aqueous polymer emulsion used in the present invention is an aqueous dispersion of a polymer which has only limited solubility in water. By limited solubility is meant to include polymers which are sufficiently water soluble to form colloidal suspensions of polymeric micelles.

The term aqueous is intended to include the optional presence of organic liquids that are miscible with water such as a polyhydric alcohol, e.g. ethylene glycol, diethylene glycol, triethylene glycol and trimethylol propane.

Conveniently the liquid in which the polymer is dispersed contains at least 30% preferably more than 50% more preferably at least 75% by weight of water. Emulsions of polymers are frequently referred to as polymer latexes and the term emulsion in the present specification is intended to include latex.

It is not essential that the emulsion polymerisation is effected in the presence of water. It is within the scope of the present invention to employ a polymer which has been prepared by emulsion polymerisation effected in the presence of an organic liquid and then to disperse the polymer emulsion in water before use in the method of the invention.

The polymer should also not be soluble in the printing ink and its glass transition temperature $T_g$ should be such that it is not brittle at the temperature encountered in the printing process.

For example the glass transition temperature is preferably not greater than about 105° C.

When the glass transition temperature is greater than about 5° C., especially when above 20° C., it is preferred to heat the plate to a temperature above the glass transition temperature to produce a coherent film after ink-jetting the image.

When the glass transition temperature is less than 5° C. it is in general not preferred to heat the plate, the exception being in the case of a polyvinylphosphonic acid post-treated plate which gives a significant improvement on heating even for low glass transition temperature polymers.

Preferably the latex is a non-core-shell system as these perform better than core-shell latex systems. The terms core-shell and non-core-shell are well known in the art.

Suitable polymer emulsions or latexes can be made by methods which are well known in the art. For example, they can be made by rapid polymerization with vigorous agitation in a liquid carrier of at least one monomer which would form a hydrophobic homopolymer. Use of more than one monomer produces copolymer latexes. Typical useful copolymers include interpolymers of acrylic esters and sulfoesters as disclosed in U. S. Pat. No. 3,411,911, interpolymers of acrylic esters and sulfobetains as disclosed in U.S. Pat. No. 3,411,912, interpolymers of alkyl acrylates and acrylic acids as disclosed in U.S. Pat. No. 3,287,289, interpolymers of vinyl acetate, alkyl acrylates and acrylic acids as disclosed in U.S. Pat. No 3,296,169 and interpolymers as disclosed in U. S. Pat. No. 3,459,790.

Polymeric emulsions or latexes suitable for use in the present invention can also be made by rapid polymerization with vigorous agitation of hydrophobic polymers when polymerized in the presence of high concentrations of surfactants which contain water-solubilizing groups. The surfactants are apparently entrained in the micelle and the solubilizing group of the surfactant provides sufficient compatibility with aqueous liquids to provide a dispersion very much like a soap.

Suitable latexes are disclosed in U.S Pat. No. 3,142,568 to Nottorf, U.S. Pat. No. 3,193,386 to White, U.S. Pat. No. 3,062,674 to Houck et al and U.S. Pat. No. 3,220,844 to Houck et al. The polymer emulsion or latex will usually have micelles about 1.0 micron average diameter or smaller and preferably less than 0.3 micron in average diameter. For use in inkjet printing plates it is desirable that the size is significantly smaller than the orifice of the ink jet nozzle to avoid clogging the opening.

The coalescence of the polymer may be assisted by heating, a suitable dispersing surfactant or the addition of a coalescent aid plasticiser or cosolvent for example methyl pyrrolidone.

According to another aspect of the invention there is provided a printing plate comprising a hydrophilic support having deposited thereon an oleophilic film of polymer which has coalesced from an aqueous emulsion of a polymer which has been prepared by emulsion polymerisation.

Preferably the polymer contains functional groups (such as sulphonate and-carboxylate or the salts thereof e.g. alkali metal) that bind the polymer to the surface of the support. The functional groups will usually be hydrophilic.

The polymer will contain a hydrophobic structure in the molecule so that it can form a hydrophobic film on the plate.

The polymer may be the polymer of one or more ethylenically unsaturated monomers, or a polyester or polyurethane.

Conveniently the molecular weight of the polymer is in the range 10,000 to 100,000 preferably about 15,000 to 40,000.

According to another aspect of the invention a printing process comprises using a printing plate having deposited thereon an image comprising an oleophilic film of coalesced polymer whose glass transition temperature is such that it is not brittle under the printing conditions and is preferably not greater than 105° C.

The ink-jet printer may be of the thermal or piezo type and may be continuous or drop on demand.

Jet velocity, separation length of the droplets, drop size and stream stability are greatly affected by the surface tension and the viscosity of the aqueous composition. Ink-jet inks suitable for use with ink-jet printing systems may have a surface tension in the range from 20 to 60, preferably 30 to 50 dynes/cm. Control of the surface tension in aqueous inks may be accomplished by addition of small amounts of surfactants. The level of surfactants to be used can be determined through simple trial and error experiments. Anionic and non-ionic surfactants may be selected from those disclosed in US Pat. Nos. 5,324,349; 4,156,616; and 5,279,654 as well as many other surfactants known in the ink-jet art. Commercial surfactants include the SURFYNOL brand products (Trade Mark) range from Air Products; the ZONYL brand products (Trade Mark) range from DuPont; the FLUORAD brand products (Trade Mark) range from 3M and the AEROSOL brand products (Trade Mark) range from Cyanamid. The viscosity of the ink is preferably no greater than 20 centipoise e.g. from 1 to 10, preferably from 1 to 5 centipoise at 20° C.

The emulsion used in the ink-jet printer may comprise other ingredients, for example water-soluble liquids or solids with a substantially higher boiling point than water, e.g. ethanediol, as well as other types of oleophilic precursors such as the sodium salt of oleic acid. A humectant or co-solvent may be included to help prevent the ink from drying out or crusting in the orifices of the print head. A penetrant may also optionally be included to help the ink penetrate the surface of the support. A biocide, such as PROXEL brand products (Trade Mark) GXL biocide from Zeneca Colours may be added to prevent microbial growth which may otherwise occur in the ink over time.

The aqueous emulsion is employed in ink-jet printing wherein drops of the emulsion are applied in a controlled fashion to the surface of the support by ejecting droplets from a plurality of nozzles or orifices in a print head of an ink-jet printer. Commercially available ink-jet printers use several different schemes to control the deposition of the ink droplets. Such schemes are generally of two types: continuous stream or drop-on-demand.

In drop-on-demand systems a droplet of ink is ejected from an orifice directly to a position on the ink receptive layer by pressure created by, for example, a piezoelectric device, an acoustic device, or a thermal process controlled in accordance with digital signals. An ink droplet is not generated and ejected through the orifice of the print head unless it is needed. Ink-jet printing methods and related printers are commercially available and need not be described in detail.

The aqueous emulsion may have properties compatible with a wide range of ejecting conditions, e.g. driving voltages, and pulse widths for thermal ink-jet printers, driving frequencies of the piezoelectric element for either a drop-on-demand device or continuous device and the shape and size of the nozzle.

The support for the lithographic printing plate is typically formed of aluminum which has been grained for example by electrochemical graining and then anodized for example by means of anodizing techniques employing sulfuric acid and/or phosphoric acid. Methods of both graining and anodizing are well known in the art.

After writing the image to the printing plate, the printing plate may be inked with printing inking the normal way and the plate used on a printing press. Before inking the plate may be treated with an aqueous solution of natural gum, such as gum acacia or of a synthetic gum such as carboxymethylcellulose, as is known in the art of printing see for example Chapter 10 of "The Lithographer's Manual" edited by Charles Shapiro and published by The Graphic Arts Technical Foundation, Inc. Pittsburgh, Pa. (1966).

Referring to the drawing: from an ink-jet printer head 2 droplets of emulsion 4 are jetted onto a hydrophilic surface 6 of a printing plate 8. The direction of movement of the printing head is indicated by the arrow. A hydrophobic image 10 is produced on the support.

The invention is illustrated by the following Examples

EXAMPLE 1

An ink jet plate fluid was prepared by mixing 3.6 grams of 42.5% Carboset CR 785 which is an acrylic copolymer latex emulsion in water (obtained from B F Goodrich Speciality Chemicals) and 26.4 grams of water. The fluid was added to an ink jet cartridge and applied to a grained and anodized aluminum substrate using an Epson 200 inkjet printer. After drying at room temperature, the plate was mounted on an AB Dick duplicator press and printed for several hundred impressions. The plate showed good ink rollup where the CR 785 fluid had been applied and showed good image quality.

EXAMPLE 2

An inkjet plate fluid was prepared by mixing 3.1 grams of 49% Vycar 460×46 which is a vinyl chloride acrylic latex emulsion in water (obtained from B F Goodrich Speciality Chemicals) and 26.9 grams of water. The fluid was added to an inkjet cartridge and applied to a grained and anodized aluminum substrate using an Epson 200 inkjet printer. After drying at room temperature, the plate was mounted on an A B Dick duplicator press and printed for several hundred impressions. The plate showed fair ink rollup where the fluid had been applied and showed good image quality.

EXAMPLE 3

An ink jet plate fluid was prepared by mixing 4.35 grams of 35% Vycar 460×46 which is a vinyl chloride acrylic copolymer latex emulsion in water and 1-methyl-2 pyrrolidone (obtained from B F Goodrich Speciality Chemicals) and 25.65 grams of water. The fluid was added to an ink jet cartridge and applied to a grained and anodized aluminum substrate using an Epson 200 printer. After drying at room temperature, the plate was mounted on an A B Dick duplicator press and printed for several hundred impressions. The plate showed good ink rollup where the fluid had been applied and showed good image quality.

EXAMPLE 4

An ink jet plate fluid was prepared by mixing 3.2 grams of 48% Carboset GA 1914 which is an acrylic copolymer latex emulsion in water (obtained from B F Goodrich Speciality Chemicals) and 26.8 grams of water. The fluid was added to an ink jet cartridge and applied to a grained and anodized aluminum substrate using an Epson 22 ink jet printer. After drying at room temperature, the plate was mounted on an A B Dick duplicator press and printed for several hundred impressions. The plate showed fair ink rollup where the fluid had been applied and showed good image quality.

EXAMPLE 5

Witcobond 404 (a polyurethane emulsion obtained from Witco Chemical Company) was diluted 1:1 with water to form an emulsion and spattered onto a grained anodized aluminum support with a toothbrush to make a lithographic printing plate. The plate was baked at 100° C. for 10 minutes, then mounted on an A B Dick duplicator press and several hundred good impressions were printed with a clean background and good ink density in the areas where the droplets had fallen on the aluminum support.

EXAMPLE 6

Witcobond 213 (a polyurethane emulsion obtained from Witco Chemical Company) was formulated according to the following Table to give 20 ml solution which was placed in an empty, clean ink-jet cartridge.

| component | stock solutions (wt %) | vol used in ink (ml) |
|---|---|---|
| polymer | 1 | 10 |
| ethanediol | 5 | 1 |
| sorbitol | 0 | 0 |
| water | | 9 |
| total | | 20 |

A standard test-object image was printed onto a grained, anodized aluminum printing plate using an Epson 200 ink-jet printer, the image allowed to dry and the plate then placed on the printing press (Heidelberg T-Offset) and run using Varn PressMaster Universal Fountain Solution (diluted 1+15) and Van Son Rubber based ink-VS310 "Pantone" black to give clear prints of the test image after rapid ink-up.

EXAMPLE 7

A dispersion of CP 310W (a chlorinated furandione-propylene copolyolefin obtained from Eastman Chemical Company) was diluted to 1% polymer with water. An image was painted onto an Autotype Omega E-Z polyester printing plate using an artist's paintbrush and allowed to dry. The plate was wetted with diluted fountain solution and rubbed with printing ink using cotton wool. A good quality inked image formed rapidly leaving the background clean.

EXAMPLE 8

Flexthane 630 (a urethane/acrylic hybrid polymer emulsion obtained from Air Products) was diluted to 1% weight polymer with water. An image was painted onto a polyvinylphosphonic acid treated aluminum printing plate and allowed to dry. The plate was wetted with diluted fountain solution and rubbed with printing ink using cotton wool. A good quality inked image formed rapidly leaving the background clean.

EXAMPLE 9

A copolymer latex prepared from styrene, butyl acrylate and itaconic acid was diluted to 1% weight polymer in water. An image was painted onto a silica/titania/alumina coated polyester printing plate and allowed to dry. The plate was wetted with diluted fountain solution and rubbed with printing ink using cotton wool. A good quality inked image formed rapidly leaving the background clean.

EXAMPLE 10

A range of homopolymers in latex form were dispersed in water at 1% wt polymer. Using an artist's paintbrush, images were painted onto a grained anodized aluminum printing plate using the resultant fluids. Two images per fluid were made and one was allowed to dry at ambient temperature and the other was dried by heating at 130° C. for 15 minutes. The plates were wetted with dilute fountain solution (Prisco Alkaless 3000 3oz in 1 US gallon of water further diluted 1:20 with water) and rubbed with printers ink on cotton wool. The resultant image was graded on a 0 to 5 scale (0 is no image, 5 is best) related to the quality and speed of inking of the printed-on image. A rating of 3 is considered acceptable.

| polymer | $T_g$ | 22° C. | 130° C., 15 min |
|---|---|---|---|
| butyl acrylate | −54° C. | 3 | 4 |
| ethyl acrylate | −24° C. | 3 | 4 |
| methyl acrylate | 5° C. | 2 | 4 |
| butyl methacrylate | 20° C. | 1 | 4 |
| tert-butyl methacrylate | 43° C. | 2 | 4 |
| ethyl methacrylate | 65° C. | 2 | 3 |
| methyl methacrylate | 105° C. | 0 | 3 |

From the table it can be seen that the polymers with lower $T_g$ form acceptable images at ambient conditions requiring no heat treatment of the plate, while those with a $T_g$ above 5° C. require heating to give acceptably inked image.

EXAMPLE 11

A similar experiment was carried out using the Autotype Omega E-Z polyester printing plate with even more noticeable differences.

| polymer | $T_g$ | 22° C. | 130° C., 15 min |
|---|---|---|---|
| butyl acrylate | −54° C. | 0 | 4 |
| ethyl acrylate | −24° C. | 0 | 4 |
| methyl acrylate | 5° C. | 0 | 4 |
| butyl methacrylate | 20° C. | 0 | 4 |
| tert butyl methacrylate | 43° C. | 0 | 4 |
| ethyl methacrylate | 65° C. | 0 | 4 |
| methyl methacrylate | 105° C. | 0 | 4 |

EXAMPLE 12

Using the same methodology as in Example 10 a series of polymers was evaluated on a polyvinylphosphonic acid post-treated grained, anodized aluminum printing plate with the results shown in the table.

| polymer | $T_g$ | 22° C. | 130° C., 15 min |
|---|---|---|---|
| butyl acrylate | −54° C. | 0 | 4 |
| ethyl acrylate | −24° C. | 0 | 4 |
| methyl acrylate | 5° C. | 0 | 4 |
| butyl methacrylate | 20° C. | 0 | 4 |
| tert butyl methacrylate | 43° C. | 0 | 4 |
| styrene/t-butyl acrylate/itaconic acid | 37.4° C. | 1 | 3 |
| Eastman* AQ 55D | 55° C. | 2 | 4 |

*Eastman AQ 55D is a sulphonated polyester.

The results show that an improved product is obtained by heating to 130° C. and also that the treatment with polyvinylphosphonic acid has as effect on the formation.

EXAMPLE 13

A series of polyester ionomers of varying molecular weight were dispersed at 1 wt % polymer in water and painted onto grained anodized aluminum and Autotype E-Z polyester printing plates.

The polymers were prepared from cyclohexane dicarboxylate (A), 5-sulfonate-isophthalate (B), cyclohexanedimethanol and a diol. The molar ratio of (A) to (B) was held constant at 42:8 respectively. The mole % of cyclohexanedimethanol and diol were varied to give a series of polymers of different molecular weight. After application, the samples were allowed to dry and the plates wetted then rubbed with printers ink on cotton wool. The scores (as described in Example 10) are shown in the table. There is clearly no molecular weight relationship.

| sample ID | aluminum | Autotype | Mn(k) |
|---|---|---|---|
| 67 | 2 | 3 | 29.3 |
| 66 | 3 | 3 | 30.9 |
| 55 | 4 | 1 | 27.6 |
| 68 | 2 | 2 | 28.0 |
| 54 | 4 | 4 | 26.0 |
| 63 | 2 | 3 | 24.9 |
| 61 | 4 | 4 | 22.2 |
| 59 | 4 | 2 | 21.9 |
| 58 | 4 | 3 | 25.0 |
| 62 | 3 | 3 | 24.1 |
| 64 | 3 | 3 | 16.7 |
| 53 | 4 | 1 | 17.8 |
| 72 | 3 | 3 | 16.0 |
| 73 | 2 | 0 | 16.0 |
| 89 | 2 | 0 | 16.0 |
| 65 | 2 | 2 | 13.5 |
| 71 | 3 | 3 | 16.0 |
| 88 | 2 | 1 | 16.0 |
| 57 | 4 | 2 | 10.8 |
| 69 | 3 | 3 | 9.2 |
| 56 | 4 | 3 | 8.3 |
| 60 | 4 | 3 | 8.0 |
| 70 | 2 | 3 | 6.9 |

In the above table Mn(k) means molecular weight number average times 1000

EXAMPLE 14

A number of core-shell latex polymers were compared with a non-core-shell latex series made from the same monomers. These were dispersed in water to 1 wt % polymer and painted onto grained, anodized aluminum printing plates and polyvinylphosphonic acid post-treated aluminum printing plates. The plates were run on press as in Example 13. The Table shows the results.

| latex | type | $T_g$ | aluminum 5 sheets | aluminum 500 sheets | PVPA-aluminum 5 sheets | PVPA-aluminum 500 sheets |
|---|---|---|---|---|---|---|
| BAG 1 | ncs | −34° C. | 4 | 5 | 3 | 2 |
| BAB 1 | ncs | −38° C. | 4 | 5 | 4 | 5 |
| BAH 1 | ncs | −33° C. | 4 | 5 | 2 | 0 |
| BA 1 | ncs | −42° C. | 4 | 5 | 2 | 0 |
| BAG 2 | cs | −40° C. | 2 | 3 | 2 | 4 |
| BAB 2 | cs | −40° C. | 2 | 1 | 1 | 0 |
| BAH 2 | cs | −40° C. | 2 | 1 | 1 | 0 |
| BAG 2 | cs | −40° C. | 0 | 0 | 0 | 0 |

BAG 1 is butylacrylate/allylmethacrylate/glycidylmethacrylate (mole % of monomers 89/2/9)

BAB 1 is butylacrylate/allylmethacrylate/butylmethacrylate (89/2/9)

BAH 1 is butylacrylate/allylmethacrylate/hydroxypropylmethacrylate (89/2/9)

BA 1 is butylacrylate/allylmethacrylate (98/2)

BAG 2 is butylacrylate/allylmethacrylate(98/2)-gycidylmethacrylate (10)

BAB 2 is butylacrylate/allylmethacrylate (98/2)-butylmethacrylate (10)

BAH 2 is butylacrylate/allylmethacrylate(98/2)-hydroxypropylmethacrylate (10)

BAG 2 is butylacrylate/allylmethacrylate(98/2)-glycidylmethacrylate (30)

From the table it is clear that non-core-shell latex polymers perform very much better than their core shell equivalents.

EXAMPLE 17

Dowfax 2A1 is supplied by The Dow Chemical Company and is dodecyl(sulphophenoxy)benzenesulphonic acid disodium salt. This is a typical dispersant for polymer emulsions and is often present in emulsions that are commercially available.

This dispersant or one similar was present in the commercially supplied emulsions used in Examples 9, 10, 11, 12, and 14.

Dowfax 2A1 was therefore made up in water to the equivalent concentration present in the latex sample. Using grained, anodized aluminum and Autotype E-Z polyester printing plates the following results were obtained using the procedure described in Example 10. The results are summarised in the table.

| material | aluminum | Autotype E-Z |
|---|---|---|
| Dowfax | 1 | 0 |
| BAG 1 | 2 | 2 |
| BG 1 | 4 | 3 |

BG 1 is butylacrylate/glycidylmethacrylate (90/10).

It is clear the surfactant on its own is not responsible for the effect seen.

EXAMPLE 16

A comparison was made between latex polymers and their equivalent polymers in solution using the method of Example 10 and the results are shown in the following table.

| polymer | solvent/latex | aluminum | Autotype E-Z |
|---|---|---|---|
| butylacrylate/glycidylmethacrylate (90/10) | latex | 4 | 3 |
| | MEK | 0 | 0 |
| butylacrylate | latex | 3 | 4 |
| | toluene | 3 | 3 |
| hydroxypropylmethacrylate | latex | 3 | 4 |
| | toluene | 3 | 0 |
| butylmethacrylate* | latex | 4 | 4 |
| | toluene | 4 | 0 |

-continued

| polymer | solvent/latex | aluminum | Autotype E-Z |
|---|---|---|---|
| tert-butylacrylate | latex | 4 | 4 |
| | toluene | 4 | 0 |

*the plates were heated to dry (100° C. for 3 minutes) as $T_g$ is greater than 20° C.

It is clear from the table that the latex polymers have an advantage over the solution polymers, particularly for the ceramic Autotype plate.

The advantages of plates prepared using aqueous polymer emulsions in the above Examples are:

(i) the plates need no processing (ii) aqueous emulsions are inexpensive and readily available commercially and can be formulated for any one of a range of inkjet devices (iii) as compared with plates prepared using solutions of polymers, the plates prepared in accordance with the invention give better image quality.

(iv) long print runs can be achieved.

What is claimed is:

1. A method for the preparation of a lithographic printing plate which method comprises forming an oleophilic image on the surface of a hydrophilic support by depositing the desired image on the surface using an aqueous emulsion of an organic polymer prepared by emulsion polymerisation wherein the polymer is film-forming and has functional groups that bind the polymer to the surface of the hydrophilic support of the printing plate forming an olephilic film.

2. A method as claimed in claim 1 wherein the oleophilic image is deposited on the surface by ink-jetting.

3. A method as claimed in claim 1 wherein the polymer has a glass transition temperature of not greater than about 105° C.

4. A method as claimed in claim 3 wherein the polymer has a glass transition temperature of above 5° C. and after deposition on the plate is subjected to a heat treatment to assist in film formation.

5. A method as claimed in claim 1 wherein the emulsion is a non-core shell system.

6. A printing plate comprising a hydrophilic support having deposited thereon an image comprising an olephilic film of polymer prepared by emulsion polymerisation and which has coalesced from an aqueous polymer emulsion, wherein the polymer contains functional groups that bind the polymer to the surface of the hydrophilic support of the printing plate.

7. A printing plate as claimed in claim 6 wherein the polymer is a polymer of one or more ethylenically unsaturated monomers, a polyester or polyurethane.

8. A printing plate as claimed in claim 7 wherein the molecular weight of the polymer is in the range 10,000 to 100,000.

9. A printing plate as claimed in claim 8 wherein the molecular weight of the polymer is in the range about 15,000 to 40,000.

* * * * *